US007699005B2

(12) United States Patent
Helander

(10) Patent No.: US 7,699,005 B2
(45) Date of Patent: Apr. 20, 2010

(54) AMMUNITION DEVICE WITH TWO ACTIVE CHARGES

(75) Inventor: Jyrki Helander, Eskilstuna (SE)

(73) Assignee: SAAB AB, Linköping (SE)

( * ) Notice: Subject to any disclaimer, the term of this patent is extended or adjusted under 35 U.S.C. 154(b) by 563 days.

(21) Appl. No.: 10/480,461

(22) PCT Filed: Jun. 11, 2002

(86) PCT No.: PCT/SE02/01134

§ 371 (c)(1),
(2), (4) Date: May 25, 2004

(87) PCT Pub. No.: WO02/101321

PCT Pub. Date: Dec. 19, 2002

(65) Prior Publication Data

US 2004/0211335 A1 Oct. 28, 2004

(30) Foreign Application Priority Data

Jun. 12, 2001 (SE) ..... 0102085

(51) Int. Cl.
*F42B 12/18* (2006.01)

(52) U.S. Cl. ..... 102/476; 102/489

(58) Field of Classification Search ..... 102/475, 102/476, 480, 489, 473
See application file for complete search history.

(56) References Cited

U.S. PATENT DOCUMENTS 372,753 A * 11/1887 Hurst ..... 102/480
697,703 A * 4/1902 Callaway ..... 102/480
1,129,169 A * 2/1915 Coats ..... 408/198
1,241,095 A * 9/1917 Courtesy ..... 102/393
1,303,877 A * 5/1919 Francois ..... 102/480
1,737,833 A * 12/1929 D Orsaneo ..... 102/480
2,804,823 A * 9/1957 Jablansky ..... 102/377
3,934,511 A 1/1976 Cordle et al.
4,063,512 A * 12/1977 Davis ..... 102/476
4,175,491 A * 11/1979 Thomanek ..... 102/476
4,305,333 A 12/1981 Altenaii et al.
4,612,859 A * 9/1986 Furch et al. ..... 102/476
4,714,022 A * 12/1987 Chaumeau et al. ..... 102/476
4,803,928 A * 2/1989 Kramer et al. ..... 102/476
4,961,382 A * 10/1990 Bai et al. ..... 102/476
4,967,666 A * 11/1990 Kellner et al. ..... 102/476

(Continued)

FOREIGN PATENT DOCUMENTS

DE 1453815 2/1969

(Continued)

OTHER PUBLICATIONS

International Search Report.

*Primary Examiner*—Troy Chambers
(74) *Attorney, Agent, or Firm*—Connolly Bove Lodge & Hutz LLP

(57) ABSTRACT

The invention relates to an ammunition arrangement. The ammunition arrangement comprises at least two active parts (2, 3), each with its own active charge (4, 6), arranged axially one behind the other. In order to make large holes in walls and the like without problems of great weight, the second active charge (6) is designed to act essentially in the radial direction at right angles to the direction of movement of the active charge.

10 Claims, 3 Drawing Sheets

U.S. PATENT DOCUMENTS

| | | | | |
|---|---|---|---|---|
| 5,005,483 | A * | 4/1991 | Deffayet | 102/489 |
| 5,078,069 | A * | 1/1992 | August et al. | 114/20.1 |
| 5,111,746 | A * | 5/1992 | Pentel et al. | 102/308 |
| 5,198,615 | A | 3/1993 | Robbie et al. | |
| 5,309,843 | A * | 5/1994 | Rentzsch et al. | 102/476 |
| 5,621,185 | A * | 4/1997 | Spengler et al. | 102/476 |
| 6,467,416 | B1 * | 10/2002 | Daniels et al. | 102/476 |
| 6,845,718 | B2 * | 1/2005 | Fortner et al. | 102/518 |
| 6,910,421 | B1 * | 6/2005 | Gethings et al. | 102/382 |
| 2005/0223930 | A1 * | 10/2005 | Bootes et al. | 102/473 |

FOREIGN PATENT DOCUMENTS

| | | |
|---|---|---|
| SE | 512 654 C2 | 4/2000 |

* cited by examiner

AMMUNITION DEVICE WITH TWO ACTIVE CHARGES

This application is a National Stage Entry of PCT/SE02/01134 filed on Jun. 11, 2002, which claims priority under 35 U.S.C. §119 to Swedish Application 0102085-8, filed on Jun. 12, 2001.

The present invention relates to an ammunition arrangement, such as a shell or the like, comprising at least a first active part with a first active charge and a second active part with a second active charge, the active parts being arranged so as to lie essentially axially one behind the other, and each of the active parts being assigned an ignition device with ignition and safety functions.

An ammunition arrangement or tandem warhead according to the first paragraph is known from inter alia our Swedish Patent 9601115-0. This type of ammunition usually consists of two shaped charges one behind the other. The front charge can function as a pre-penetrator and opens the way for the following main charge. This tandem principle has proved effective in many situations and can penetrate thick protection in the form of armour plate and the like.

In some situations, however, it is desirable to produce an ammunition arrangement which acts differently. In combat in towns and villages, for example, it is desirable for it to be possible to make large holes in concrete walls and brick walls in a simple manner, so that a soldier, preferably with full equipment, can pass through. At the same time, there are very exacting requirements for low weight. The main reason for the strict weight requirements is that it is to be possible for the warhead to be fired softly, and this functions only for low flying weights. Another reason is that it is to be possible for the ammunition arrangement or warhead to be carried by a soldier with full equipment.

The object of the present invention is to produce an ammunition arrangement which can make large holes in walls and other similar constructions and which at the same time has a low weight.

The object of the invention is achieved by an ammunition arrangement characterized in that the second active charge is designed to act essentially in the radial direction at right angles to the direction of movement of the active charge. By virtue of this design, an action radially outwards from the active charge is obtained, which effectively opens up large holes in wall-like material.

In this connection, it may be mentioned that active charges of the type proposed for the second active charge are in principle previously known in other connections (see, for example, U.S. Pat. No. 3,934,511). One type is known as a "prismaladdning" in Swedish and as a "linear shaped charge" in English. Our inventive idea is based on combining a main charge in the form of an active charge with essentially radial action with a pre-penetrator in order to produce large holes. The combination of charges results in effective action even in light charges.

According to an advantageous embodiment, the second active charge, which is delimited by a front surface, a rear surface and an intermediate surface, is designed with a liner in the intermediate surface. The liner advantageously consists of one or more concave portions distributed around the intermediate surface. A proposed number of concave portions which may be suitable is four.

According to another advantageous embodiment, the second active charge, which is delimited by a front surface, a rear surface and an intermediate surface, is provided, in conjunction with the intermediate surface, with bars arranged essentially parallel to the direction of movement of the ammunition arrangement. The bars included according to this embodiment cut in an effective manner any reinforcement rods forming part of the wall or the like to be opened up.

According to a further advantageous embodiment, the first active charge consists of a shaped charge. The inclusion of a shaped charge as the first active charge in combination with a cylindrical charge according to the characteristic in Patent claim 1 as the second active charge results in a favourable interaction which can effectively produce a large hole.

In order to optimize the interaction between the two active charges, a delay can be introduced, which delays the ignition of the second active charge in relation to the ignition of the first active charge.

The invention will be described in greater detail below by means of some illustrative embodiments with reference to the accompanying drawings, in which.

Figure 3A:
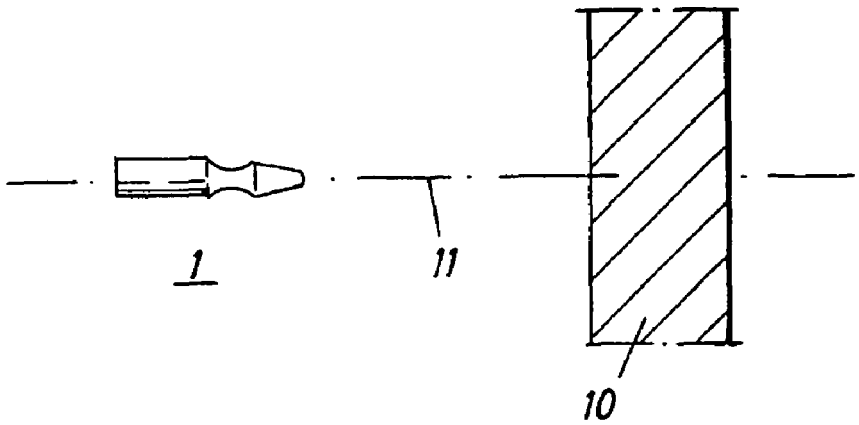
Figure 3B:
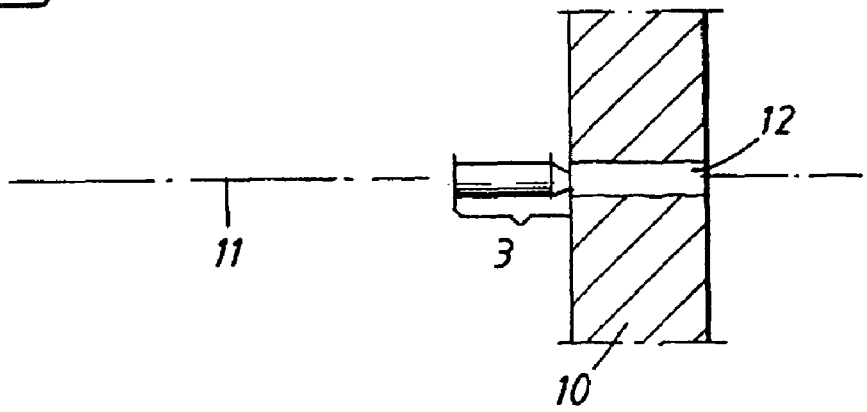
Figure 3C:
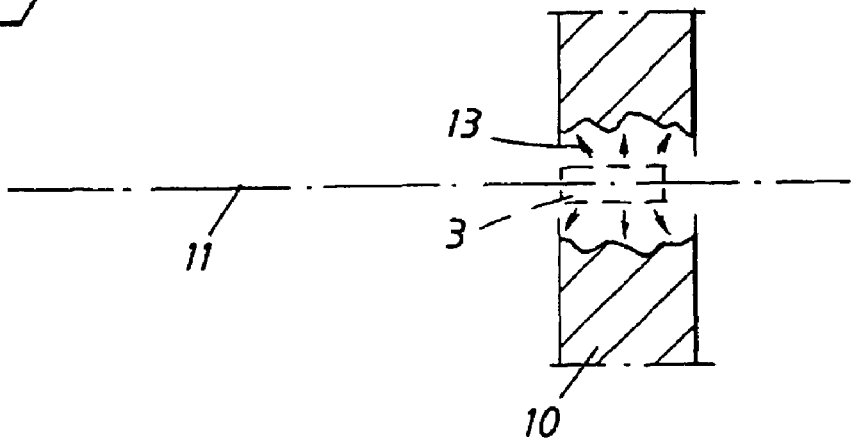
Figure 4:
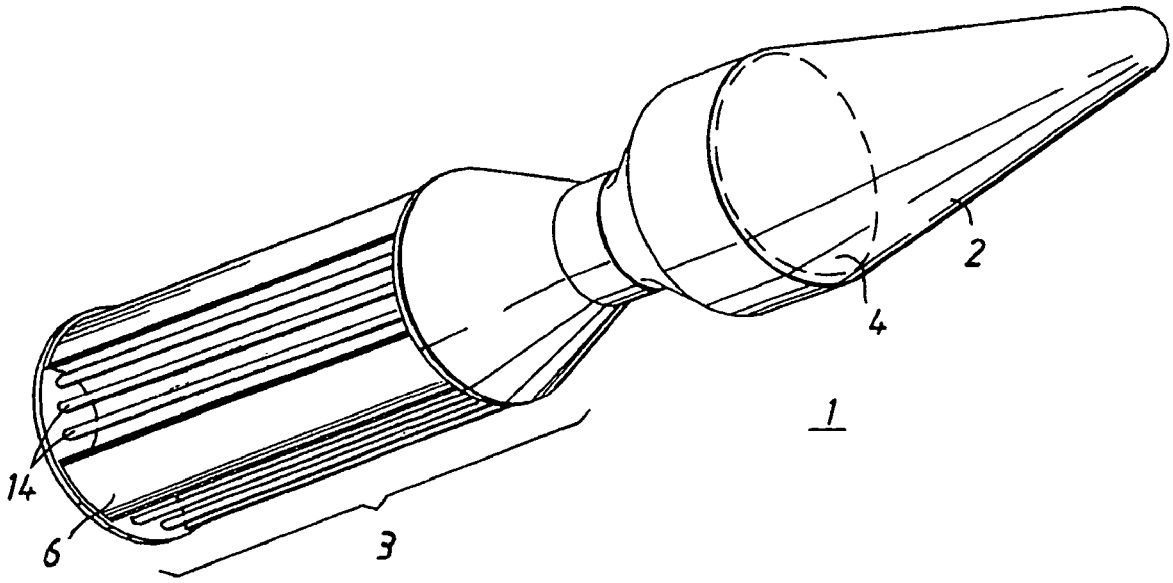

FIGS. 3*a*-3*c* illustrate diagrammatically the principle of action of the ammunition arrangement when firing at a wall, and FIG. 4 shows diagrammatically a second example of an ammunition arrangement according to the invention.

Figure 1:
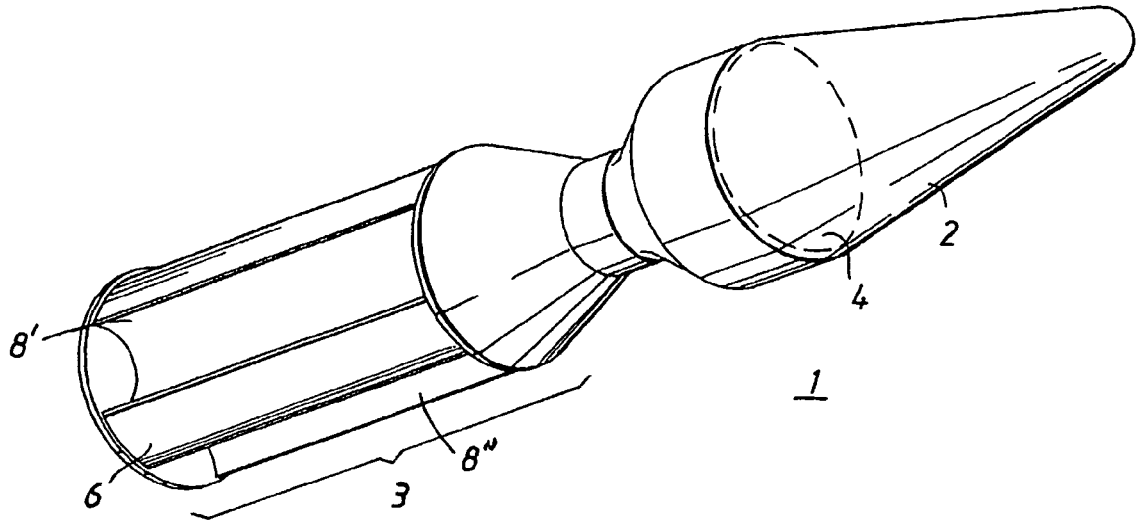
FIG. 1 shows diagrammatically an example of an ammunition arrangement according to the invention.
Figure 2:
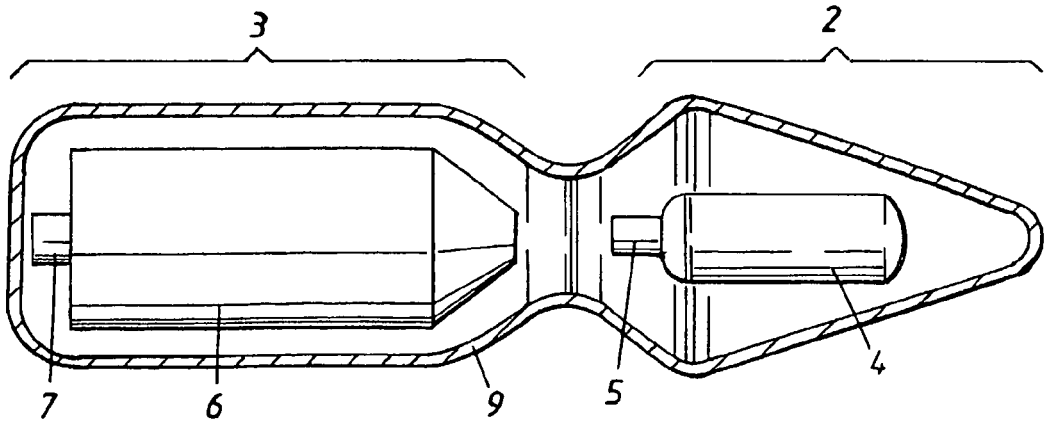
FIG. 2 shows diagrammatically a central section through the ammunition arrangement according to FIG. 1 in a section without liner.

The ammunition arrangement 1 shown diagrammatically in FIGS. 1 and 2, which can consist of a shell or the like, comprises a first active part 2 and a second active part 3. The first active part 2, also referred to as a pre-penetrator, comprises a first active charge 4 and an ignition device 5. The active charge 4 can be of the shaped charge type, but other types are also possible. The active charge 4 is preferably designed primarily to act in the direction of movement of the charge. The second active part 3 comprises a second active charge 6, also referred to as the main charge, and consists in this embodiment of what is known as a linear shaped charge. An ignition device 7 is arranged in conjunction with the second active charge 6.

An example of the design of the second active charge 6 is shown in FIG. 1. The charge 6 is essentially cylindrical with a liner 8 designed in the lateral surface of the cylindrical charge. The liner 8 is constructed from a number of concave portions, two portions 8', 8" of which are shown. In FIG. 2, the active parts 2 and 3 are shown enclosed in a case 9.

The functioning of the ammunition arrangement according to the invention is described in greater detail with reference to FIGS. 3*a*-3*c*.

FIG. 3*a* shows a situation where a soldier has just launched the ammunition unit 1 towards a target in the form of, for example, a wall portion 10. Although reference will be made to a wall portion below, it is understood that the target may also consist of roof and/or floor portions or other comparable constructions made of, for example, brick or concrete. The section shown in the wall portion 10 is intended to pass through the centre axis 11 of the ammunition arrangement.

In FIG. 3*b*, the ammunition arrangement has reached the target. To be precise, the first active charge 4 functioning as a pre-penetrator has acted and produced a hole 12 in the wall portion 10. In a case where the first active charge 4 consists of a shaped charge, a shaped charge jet is formed on, for example, impact against the wall portion 10, which creates the hole 12 shown.

In FIG. 3*b*, the ammunition arrangement has penetrated more deeply into the wall portion 10. The second active charge is now located in principle in the hole 12 made by the first active charge 4 and is initiated here. Owing to the second active charge being designed with a liner consisting of longitudinal cavities, knife-like jets are formed, which act essentially radially outwards from the centre of the original hole. Any reinforcement rods are cut effectively, and a large hole is produced. Arrows 13 in FIG. 3*c* indicate some directions in which forces from the second active charge 6 act.

The illustrative embodiment shown in FIG. 4 has a different type of second active charge but otherwise corresponds to the ammunition arrangement described previously. Components which correspond to those in FIG. 1 have been given the same reference numbers. In the embodiment according to FIG. 4, the second active charge 3 does not have a liner. Instead, the second active charge 3 comprises parallel metal bars 14 arranged in cavities of the charge and parallel to the direction of movement of the active charge. In connection with the second active charge 3 being activated, the parallel bars 14 will, by the force of the charge, be spread radially outwards from the charge. In this way, the wall or the like which the active charge has penetrated will, with the aid of the bars, open up a large hole, as the bars attack and break apart in an effective manner any integrally cast reinforcement in the wall which is to be opened up.

The invention is not limited to the embodiments shown above by way of example but can undergo modifications within the scope of the patent claims below.

For example, the liner can be given many different shapes. According to one embodiment, the liner can be of entirely flat design. Another example of a possible shape is hemispherical. The liner does not have to have gentle transitions either, but can, for example, have an abrupt transition in the bottom part of the cavities.

There is also great freedom as far as the positioning of the metal bars around the active charge is concerned. As shown in the illustrative embodiment, the bars can be concentrated in special cavities. It is also possible to distribute the bars more uniformly around the peripheral surface of the active charge. There is also great freedom with regard to the selection of dimensions and the number of bars.

The invention claimed is:

1. Ammunition, comprising:

a first active part having a first active charge arranged to act substantially along a direction of movement of the ammunition and to create a hole in a target; and a second active part having a second active charge, wherein the second active part is completely disposed axially behind the first active part, and the second active charge is arranged to act substantially radially outwardly from the ammunition and radially outwardly from said hole to enlarge said hole, and wherein the second active charge is dilimited by a front surface, a rear surface and an intermediate surface, with a liner in the intermediate surface, and wherein the liner comprises a plurality of longitudinal cavities distributed around the intermediate surface and wherein the longitudinal cavities extend from the front surface to the rear surface of the second active charge; and wherein:

the ignition device of the second active part ignites the second active charge with a delay after ignition of the first active charge.

2. The ammunition of claim 1, wherein:

the second active charge acts in a direction generally at right angles to the direction of movement.

3. The ammunition of claim 1, wherein:

the liner comprises four concave portions.

4. The ammunition of claim 3, wherein:

a plurality of bars are arranged in the concave portions.

5. The ammunition of claim 4, wherein:

the bars are arranged substantially parallel along a length of the ammunition.

6. The ammunition of claim 1, wherein:

the first active charge is a shaped charge.

7. The ammunition of claim 1, wherein:

each of the active parts is assigned an ignition device.

8. The ammunition of claim 1, wherein the ammunition is a shell.

9. A method of firing and operating ammunition, comprising:

providing a shell comprising:

a first active part having a first active charge; and a second active part having a second active charge, wherein the second active part is completely disposed axially behind the first active part in the shell;

firing the shell from a weapon so that the shell travels along a direction;

igniting the first active charge, wherein the first active charge acts substantially along the direction of travel;

igniting the second active charge, wherein the second active charge acts substantially radially outwardly from the shell and radially outwardly from a hole created by said first active part to enlarge said hole, and wherein the second active charge is delimited by a front surface, a rear surface and an intermediate surface, with a liner in the intermediate surface, and wherein the liner comprises a plurality of longitudinal cavities distributed around the intermediate surface and wherein the longitudinal cavities extend from the front surface to the rear surface of the second active charge; and wherein the step of igniting the second active charge comprises:

igniting the second active charge afler a delay afler igniting the first active charge.

10. The method of claim 9, wherein providing a shell comprises:

providing a plurality of bars disposed around the second active charge.

* * * * *